US010438472B2

(12) United States Patent
Haynes et al.

(10) Patent No.: US 10,438,472 B2
(45) **Date of Patent: *Oct. 8, 2019**

(54) SYSTEMS AND METHODS FOR CONTROLLING ELECTRICAL CURRENT AND ASSOCIATED APPLIANCES AND NOTIFICATION THEREOF

(71) Applicants: Michael L. Haynes, Denver, CO (US); Sylvester C. Maier, Jr., Kailua-Kona, HI (US)

(72) Inventors: Michael L. Haynes, Denver, CO (US); Sylvester C. Maier, Jr., Kailua-Kona, HI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/709,248

(22) Filed: May 11, 2015

(65) Prior Publication Data

US 2015/0269821 A1 Sep. 24, 2015

Related U.S. Application Data

(63) Continuation-in-part of application No. 13/491,097, filed on Jun. 7, 2012, now Pat. No. 9,030,319, which (Continued)

(51) Int. Cl.
*G08B 1/00* (2006.01)
*G08B 17/10* (2006.01)
(Continued)

(52) U.S. Cl.
CPC ..... *G08B 17/10* (2013.01); *F23N 5/242* (2013.01); *G08B 1/08* (2013.01); *G08B 17/00* (2013.01); *H01H 83/00* (2013.01)

(58) Field of Classification Search
CPC ..... G08B 17/00; G08B 17/10; G08B 19/00; G08B 19/005; G08B 1/08; F24C 3/12; (Continued)

(56) References Cited

U.S. PATENT DOCUMENTS 4,496,817 A * 1/1985 Smith ..... 219/707
4,612,535 A * 9/1986 Sequin et al. ..... 340/539.26
(Continued)

OTHER PUBLICATIONS

PCT/US2016/029973 International Search Report, dated Jun. 24, 2016, 12 pages.

*Primary Examiner* — Ryan Sherwin

(57) ABSTRACT

A digital electronic system used for receiving an audio alarm from a smoke detector, a carbon monoxide detector and like detectors. The system amplifies and converts the alarm to a digital encoded radio frequency signal for shutting off power to a kitchen appliance. The system includes a microphone and an amplifier connected to a comparator circuit. This circuit provides for outputting a logic 0 or logic 1 and outputs logic 1, in the form of the digital radio frequency signal, if an audio alarm is received. The comparator circuit is connected to a transmitter and encoder circuit, which receives the frequency signal and transmits it to a radio frequency receiver and decoder circuit. This circuit then decodes the signal and disconnects the power to the appliance.

32 Claims, 7 Drawing Sheets

Related U.S. Application Data is a continuation of application No. 12/072,506, filed on Feb. 25, 2008, now abandoned.

(60) Provisional application No. 60/903,744, filed on Feb. 26, 2007.

(51) Int. Cl.

| | |
|---|---|
| ***H01H 83/00*** | (2006.01) |
| ***G08B 17/00*** | (2006.01) |
| ***F23N 5/24*** | (2006.01) |
| ***G08B 1/08*** | (2006.01) |

(58) Field of Classification Search

CPC ..... F24C 3/122–3/128; F24C 7/08; F24C 7/081–7/088; F23N 5/242; H01H 83/00

See application file for complete search history.

(56) References Cited

U.S. PATENT DOCUMENTS

| | | | | |
|---|---|---|---|---|
| 4,630,684 | A * | 12/1986 | Cinzori | G08B 17/00 169/46 |
| 4,984,637 | A * | 1/1991 | Finnigan | 169/61 |
| 5,349,162 | A * | 9/1994 | Holling | 219/445.1 |
| 5,379,453 | A * | 1/1995 | Tigwell | 455/151.2 |
| 6,348,766 | B1 * | 2/2002 | Ohishi | H05B 33/0893 315/185 R |
| 6,529,126 | B1 * | 3/2003 | Henry | 340/467 |
| 6,529,162 | B2 | 3/2003 | Newberg et al. | |
| 8,611,062 | B2 * | 12/2013 | Bishop et al. | 361/93.6 |
| 8,807,523 | B2 * | 8/2014 | Pitchford et al. | 251/129.04 |
| 8,836,522 | B2 * | 9/2014 | Thorpe | H02H 3/02 137/38 |
| 9,030,319 | B1 * | 5/2015 | Haynes | 340/539.22 |
| 2004/0145466 | A1 * | 7/2004 | Anthony et al. | 340/522 |
| 2005/0156730 | A1 * | 7/2005 | Chapman et al. | 340/506 |
| 2006/0044133 | A1 * | 3/2006 | Lou | 340/531 |
| 2008/0018484 | A1 * | 1/2008 | Sager | 340/628 |
| 2014/0098445 | A1 * | 4/2014 | Hooper | H02H 3/16 361/42 |
| 2014/0375144 | A1 * | 12/2014 | Thorpe | G05B 9/02 307/129 |
| 2016/0260313 | A1 * | 9/2016 | Thorpe | G08B 21/24 |

* cited by examiner

SYSTEMS AND METHODS FOR CONTROLLING ELECTRICAL CURRENT AND ASSOCIATED APPLIANCES AND NOTIFICATION THEREOF

CROSS-REFERENCE TO RELATED APPLICATIONS

This application is a continuation-in-part of U.S. patent application Ser. No. 13/491,097, filed on Jun. 7, 2012, which is a continuation of U.S. patent application Ser. No. 12/072,506, filed on Feb. 25, 2008, which in turn claims the benefit of U.S. Provisional Patent Application No. 60/903,744, filed on Feb. 26, 2007. The foregoing applications are incorporated by reference herein in their entireties.

FIELD OF THE INVENTION

This disclosure relates generally to systems and methods for turning "on" and shutting "off" an electrical circuit, or alternatively the electrical current provided to, by way of example but not limitation, an electrical appliance.

BACKGROUND OF THE INVENTION

There are various known systems for controlling power distribution within a home or office setting. Those prior art systems, however, suffer from certain drawbacks and disadvantages, which have previously been inadequately addressed.

For example, in U.S. Pat. No. 5,508,568 to Mammen, a receptacle safety de-energizer is described. The de-energizer is plugged into a standard electrical power outlet. An electrical plug for a kitchen appliance is connected to the de-energizer. The system includes a power circuit and a protected receptacle connected in series with a building wiring system. The de-energizer does not include a digital transmitter or a digital receiver for receiving a digital encoded radio frequency signal. This prior art patent doesn't specifically disclose the unique features and electrical circuitry used in the subject digital electronic system for receiving an audio alarm from a smoke detector as described herein.

SUMMARY OF THE INVENTION

The invention disclosed herein relates generally to systems and methods for turning "on" and shutting "off" an electrical circuit, or alternatively the electrical current provided to, by way of example but not limitation, an electrical appliance. In various embodiments described herein, the disclosure includes the use of an electrical circuit, which is particularly adapted for use in a home or an office building, and which may be used to control power provided to specific circuits in the home or office, such as kitchen appliances, space heaters, furnaces, clothes dryers, Christmas tree lights, and other electrically operated or gas operated appliances. The circuit is preferably used to prevent a potential fire or carbon monoxide poisoning. Also, the system can be operated, via the internet, using an internet protocol incorporated into a microprocessor used with the electrical circuit.

More particularly, but not by way of limitation, the electronic system described herein can be used for receiving an audio alarm from a smoke detector, a carbon monoxide detector and similar alarms by amplifying and converting the alarm to a digital encoded signal. The encoded signal can then be transmitted as a digital radio frequency signal used for shutting off electrical power or gas to one or more kitchen appliances and other electrical apparatus.

In view of the foregoing, it is a primary objective of the subject invention to provide a digital electronic system that is responsive to an audio alarm from a smoke detector, carbon monoxide detector and similar alarm detectors. The system is used to shut off a utility, for example electric power or gas to one or more kitchen appliances, and avoid a potential kitchen fire or fire from other electrical and gas appliances located in a home or office building, or alternatively turn on a utility or other device.

A key object of the subject system is the use of a programmed microprocessor with internet protocol incorporated into the circuitry. This feature allows the user of the system, from a remote location and via the internet or a private network, to determine if the electronic system has been activated and therefore respond to an alarm.

Another object of the invention is the digital electronic system is readily adaptable for plugging into a standard 110 volt or 220 volt AC outlet used in residential and commercial buildings. Also the system can be used equally well in a hard wire application. Further, the system is adapted for receiving a standard plug or connector used with various kitchen appliance and other electrical and gas operated items.

Yet another object of the invention is the system can be used to control a circuit breaker in a main circuit panel in a residential or commercial property. Also, the use of a radio signal, a hard wire signal or an internet protocol signal can be used by the system to allow delivery of information about the circuit panel and where the smoke detector, carbon monoxide detector and other alarms are located and which one has been activated.

A further object of the electronic system is the use of a microphone and transmitter to amplify and convert a smoke detector, a carbon monoxide detector or other audio alarm to a digital encoded radio frequency signal. The digital radio frequency signal is received by a radio frequency receiver and compared, recognized and decoded for turning "on" or "off" a particular device, such as electrical power or gas to one or more appliances.

Still further, the electronic system includes a microphone and transmitter that can be conveniently placed at various locations in a building, such as a kitchen, with a smoke detector and a receiver connected to the electrical appliance positioned at a remote location.

The subject invention includes a microphone and an amplifier connected to a comparator circuit. Also, the system includes a programmable microprocessor with internet protocol, a rectifier diode and a surge protector. The comparator circuit provides for outputting logic "0" or a logic "1". The circuit outputs logic 1, in the form of a digit radio frequency signal, if the audio alarm from the smoke or other detector is received. The comparator circuit is connected to a transmitter and encoder circuit. The transmitter and encoder circuit receive a digital radio frequency signal from the comparator circuit and transmits the signal to a radio frequency receiver and decoder circuit. The receiver and the decoder circuit decodes the digital radio frequency signal and disconnects the power to the appliance or circuit breaker. Alternatively, a message is set to an appropriate person for responding to the alarm event.

These and other objects of the present invention will become apparent to those familiar with the systems and electrical circuits used with kitchen appliances and the like when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the claims set forth herein below define the invention.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

In the drawings:

FIG. 1 is a front view of the subject digital electronic system received on a kitchen cabinet and used for use in preventing a potential fire, or carbon monoxide poisoning, or from any other hazardous gas, by shutting off one or more kitchen appliances;

FIG. 2 is a circuit diagram of the microphone and amplifier comparator circuit using a microphone and amplifier used in the subject invention;

FIG. 3 is a circuit diagram of a radio frequency transmitter and antenna;

FIG. 4 is a circuit diagram of a radio frequency receiver and decoder and connected to a power source and an electric appliance;

FIG. 5 illustrates another embodiment of the invention's circuitry;

FIG. 6 illustrates another example of a circuit diagram of the microphone and amplifier comparator;

Figure 7:
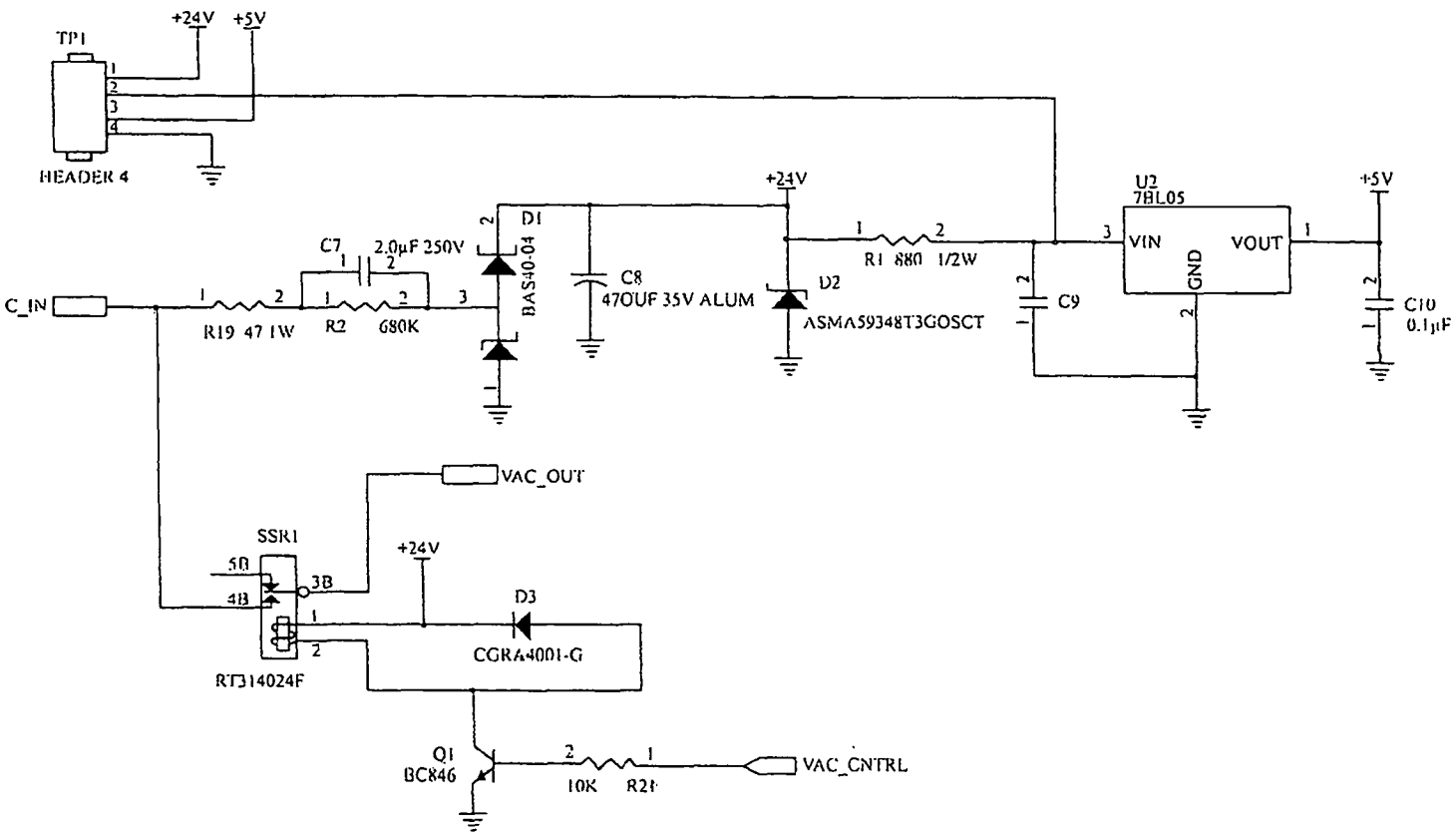
Figure 8:
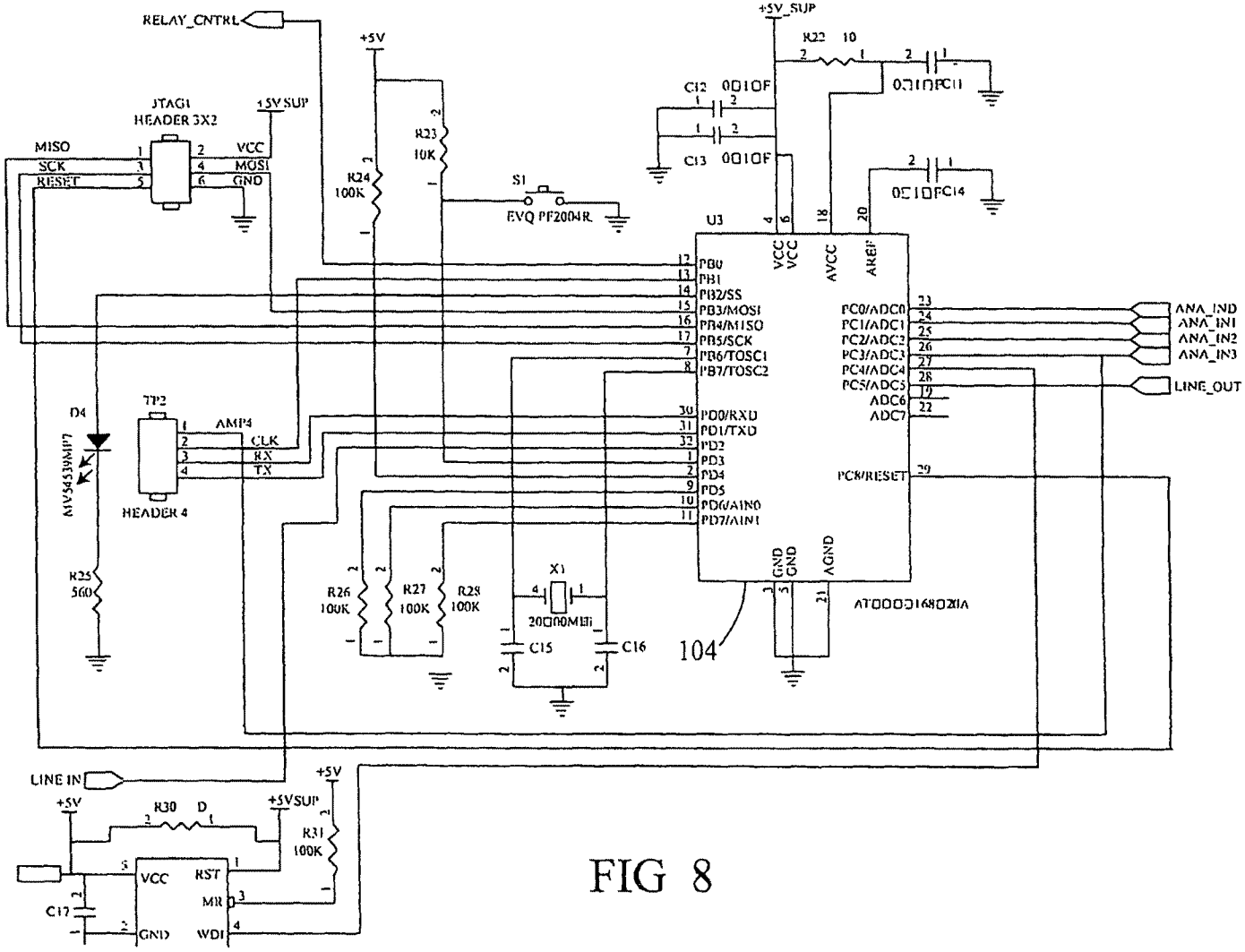

FIG. 7 shows a diagram of a circuit that is used to switch or control another electrical circuit protected by the subject invention; and FIG. 8 is a circuit diagram of a programmable microprocessor with internet protocol used to control the system, wherein the internet protocol allows a user of the electronic system to operate the circuitry from a remote location via a network from a mobile device.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. Furthermore, ellipses within the figures represent that the component, data structure, etc. can include more or fewer elements than those shown in the figure.

DETAILED DESCRIPTION OF THE PREFERRED EMBODIMENTS

The term "computer-readable medium" as used herein refers to any tangible storage that participates in providing instructions to a processor for execution. Such a medium may take many forms, including but not limited to, non-volatile media, volatile media, and transmission media. Non-volatile media includes, for example, NVRAM, or magnetic or optical disks. Volatile media includes dynamic memory, such as main memory. Common forms of computer-readable media include, for example, a floppy disk, a flexible disk, hard disk, magnetic tape, or any other magnetic medium, magneto-optical medium, a CD-ROM, any other optical medium, punch cards, paper tape, any other physical medium with patterns of holes, a RAM, a PROM, and EPROM, a FLASH-EPROM, a solid state medium like a memory card, any other memory chip or cartridge, or any other medium from which a computer can read. When the computer-readable media is configured as a database, it is to be understood that the database may be any type of database, such as relational, hierarchical, object-oriented, and/or the like. Accordingly, the invention is considered to include a tangible storage medium and prior art-recognized equivalents and successor media, in which the software implementations of the present invention are stored.

The term "mobile device" or "mobile computer" as used herein refers to any hardware device and/or software operable to engage in a computing session. For example, a mobile device can be an IP-enabled computer, a tablet computer, a cellular phone, a personal digital assistant, a laptop computer system, etc. In embodiments, the mobile computer is a computer system as described in conjunction with FIGS. 1-8.

The term "network" as used herein refers to a system used by a communication platform to provide communications between mobile computers. The network can consist of one or more session managers, feature servers, mobile computers, etc. that allow communications, whether voice or data, between two users. A network can be any network or communication system as described in conjunction with FIGS. 1-8. Generally, a network can be a local area network (LAN), a wide area network (WAN), a wireless LAN, a wireless WAN, the Internet, etc. that receives and transmits messages or data between devices to facilitate communication platform activities. A network may communicate in any format or protocol known in the art, such as, transmission control protocol/internet protocol (TCP/IP), 802.11g, 802.11n, Bluetooth, or other formats or protocols.

The term "database," "archive," or "data structure" as used herein refers to any system, hardware, software, memory, storage device, firmware, component, etc., that stores data. The data model can be any type of database or storage framework described in conjunction with FIGS. 1-8, which is stored on any type of non-transitory, tangible computer readable medium. A database can include one or more data structures, which may comprise one or more sections or portions that store an item of data. A section may include, depending on the type of data structure, an attribute of an object, a data field, or other types of sections included in one or more types of data structures. The data structure can represent a text string or be a component of any type of database, for example, relational databases, flat file databases, object-oriented databases, or other types of databases. Further, the data structures can be stored in memory or memory structures that may be used in either run-time applications or in initializing a communication.

The term "logic" as referred to herein relates to structure for performing one or more logical operations. For example, logic may comprise circuitry which provides one or more output signals based upon one or more input signals. Such circuitry may comprise a finite state machine which receives a digital input and provides a digital output, or circuitry which provides one or more analog output signals in response to one or more analog input signals. Such circuitry may be provided in an application specific integrated circuit (ASIC) or field programmable gate array (FPGA). Also, logic may comprise machine-readable instructions stored in a memory in combination with processing circuitry to execute such machine-readable instructions. However, these are merely examples of structures which may provide logic and embodiments are not limited in this respect.

The terms "logic instructions" as referred to herein relates to expressions which may be understood by one or more machines for performing one or more logical operations. For example, logic instructions may comprise instructions which are interpretable by a processor compiler for executing one or more operations on one or more data objects. However, this is merely an example of machine-readable instructions, and embodiments described herein are not limited in this respect.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

The terms "determine", "calculate" and "compute," and variations thereof, as used herein, are used interchangeably and include any type of methodology, process, mathematical operation or technique.

The term "identifier (ID)" and variations thereof, as used herein, refers to An identifier as described herein can be an numeric, alphanumeric, symbolic, globally unique identifier, or other identifier as understood in the art.

The term "module" refers to any known or later developed hardware, software, firmware, artificial intelligence, fuzzy logic, or combination of hardware and software that is capable of performing the functionality associated with that element. Also, while the various concepts are described in terms of exemplary embodiments, it should be appreciated that aspects can be separately claimed.

Hereinafter, "in communication" shall mean any electrical connection, whether wireless or wired, that allows two or more systems, components, modules, devices, etc. to exchange data, signals, or other information using any protocol or format.

The phrases "at least one", "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

Reference in the specification to "one embodiment" "some embodiments" or "an embodiment" means that a particular feature, structure, or characteristic described in connection with the embodiment is included in at least an implementation. The appearances of the phrase "in one embodiment" in various places in the specification may or may not be all referring to the same embodiment.

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

In certain embodiments described herein, the devices are all configured to communicate via a network. For example, the network communication protocol may be configured for communication via "Internet Protocol" (IP) and thereby communicate with one or more applications such that the devices associated therewith may be accessible and addressable via, by way of example but not limitation, desktop computers, laptop computers, tablets, portable desktop accessories, hand held and mobile electronic devices, including those devices as defined herein.

The systems and methods described herein are further able to integrate with existing emergency response, fire, burglar, or other security/monitoring/alarm systems or detection control systems, including for both home and commercial settings. The systems described herein generally allow an individual to "turn on", "turn off" and/or regulate communicate with any associated devices.

Figure 1:
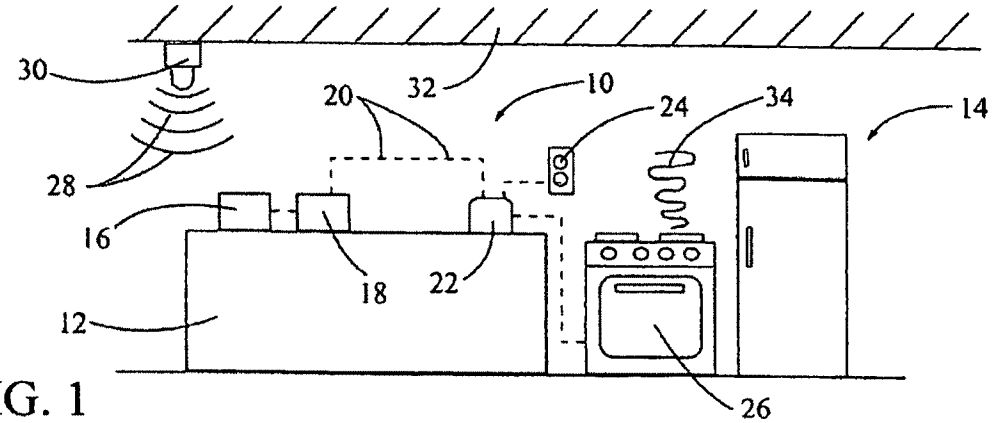

Various embodiments of the systems and methods of this disclosure are generally shown in connection with FIGS. 1-8. In FIG. 1, a front view of the subject digital electronic system is illustrated and having general reference numeral 10. In this application, the electronic system 10 is shown received on top of a kitchen cabinet 12 in a kitchen 14. The electronic system 10 broadly includes a microphone and amplifier comparator circuit 16 connected to a radio frequency transmitter and encoder circuit 18. The transmitter and encoder circuit 18 is used for outputting a digital radio frequency signal 20, shown in dashed lines, to a receiver and decoder circuit 22. The receiver and decoder circuit 22 is connected to a wall outlet power source 24, next to a kitchen stove 26.

In this drawing, the microphone and amplifier comparator circuit 16 is shown receiving an audio alarm 28 from a smoke detector 30 mounted in a ceiling 32 of the kitchen 14. While the smoke detector 30 is discussed herein, the subject electronic system 10 will work equally well with a carbon monoxide detector and similar alarm devices.

In this example, a stove fire, indicated by smoke 34, has started and the digital electronic system 10 is responding to the audio alarm 28 for shutting off the power to the stove 26. Obviously, the example of a kitchen stove fire 34 is one of any number of examples the subject electronic system 10 can be used in conjunction with the audio alarm 28 from a smoke detector 30 or a carbon monoxide detector and similar detectors. Also, the circuits 16, 18 and 22 can be mounted in different sizes of housings for wall mounting or free standing on a shelf or table. The housings for the circuits are not shown in the drawings. Further, the microphone and amplifier comparator circuit 16 and transmitter and encoder circuit 18 can be placed at various locations and distances apart from the receiver and decoder circuit 22 for transmitting the digital radio frequency signal 20 thereto.

Figure 2:
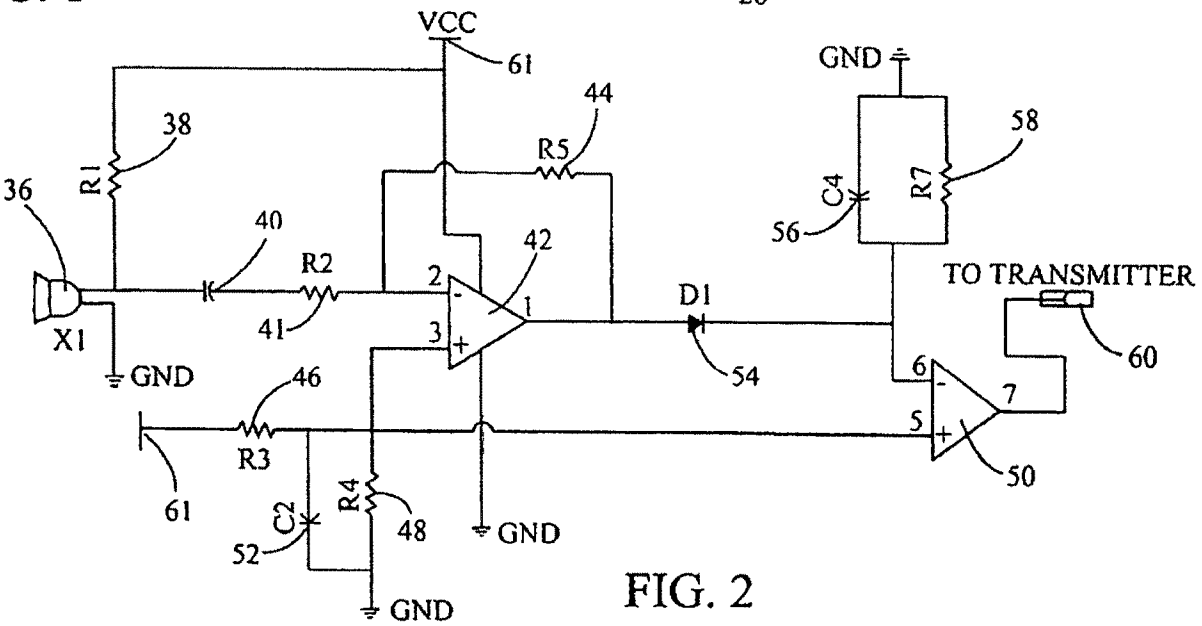

In FIG. 2, a circuit diagram of the microphone and amplifier comparator circuit 16 is shown. This circuit is used to pick up the audio alarm 28 from the smoke detector 30 and output a logic 1 (or high) to the transmitter and encoder circuit 18, if the alarm 28 is actuated. Obviously, if no alarm is received, the output from the circuit 16 stays logic 0 (or low).

The circuit 16 shown in this drawing includes a microphone 36 connected to a resistor 38. The resister 38 is used for biasing the electronic microphone. The microphone 36 is also connected to a first capacitor 40, a resistor 41 and a first amplifier 42 for amplifying a microphone signal from the microphone 36. Resistors 38 and 44 are used to set the gain of the first amplifier 42 to a value of 100. Resistors 46 and 48 set the bias operating point of the first amplifier 42 and a second amplifier 50. A second capacitor 52 provides a high frequency bypass for the bias voltage source between the resistors 46 and 48.

A diode 54 is used to rectify the output of the first amplifier 42 and creates a DC voltage, which is dependent on the amplitude of the audio alarm 28 received by the microphone 36. A third capacitor 56 and resistor 58 provide a filter network that charges upon the receipt of a high amplitude sound wave from the microphone 36. When the voltage of pin 6 on the second amplifier 50 exceeds the bias voltage on pin 5 on the amplifier, the output from the amplifier 50 connected to a transmitter pin 60 goes from a high voltage to a low voltage. This change in voltage provides the output logic 1 to the transmitter and encoder circuit 18 via the transmitter pin 60. The circuit 16 is powered by a low voltage battery power source 61.

Figure 3:
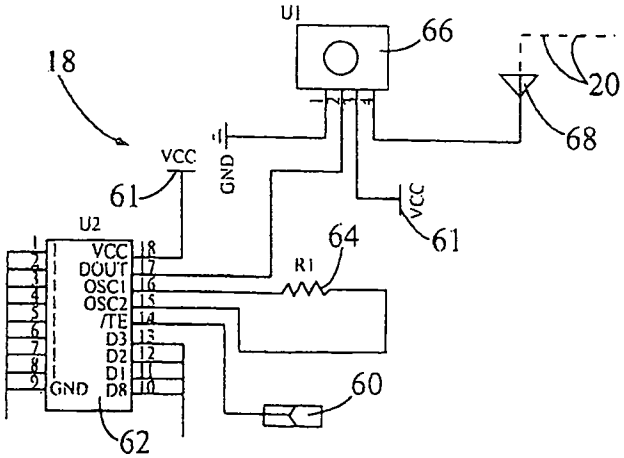

In FIG. 3, a circuit diagram of the transmitter and encoder circuit 18 is illustrated. The circuit 18 includes an encoder 62 connected to a resistor 64 and to a transmitter 66. The transmitter 66 includes an antenna 68. When the encoder 62 receives a logic 1 (or high) output signal from the transmitter pin 60, the encoder circuit 18 feeds an encoded data stream to the transmitter 66. In turn, the transmitter 66 transmits the encoded radio frequency signal 20 to the receiver and decoder circuit 22 using the antenna 68. The transmitter 66 operates in a frequency range of 300 to 1500 MHz with AM radio signal modulation. The radio frequency output power into 50 ohms is typically 14 dbm.

Figure 4:
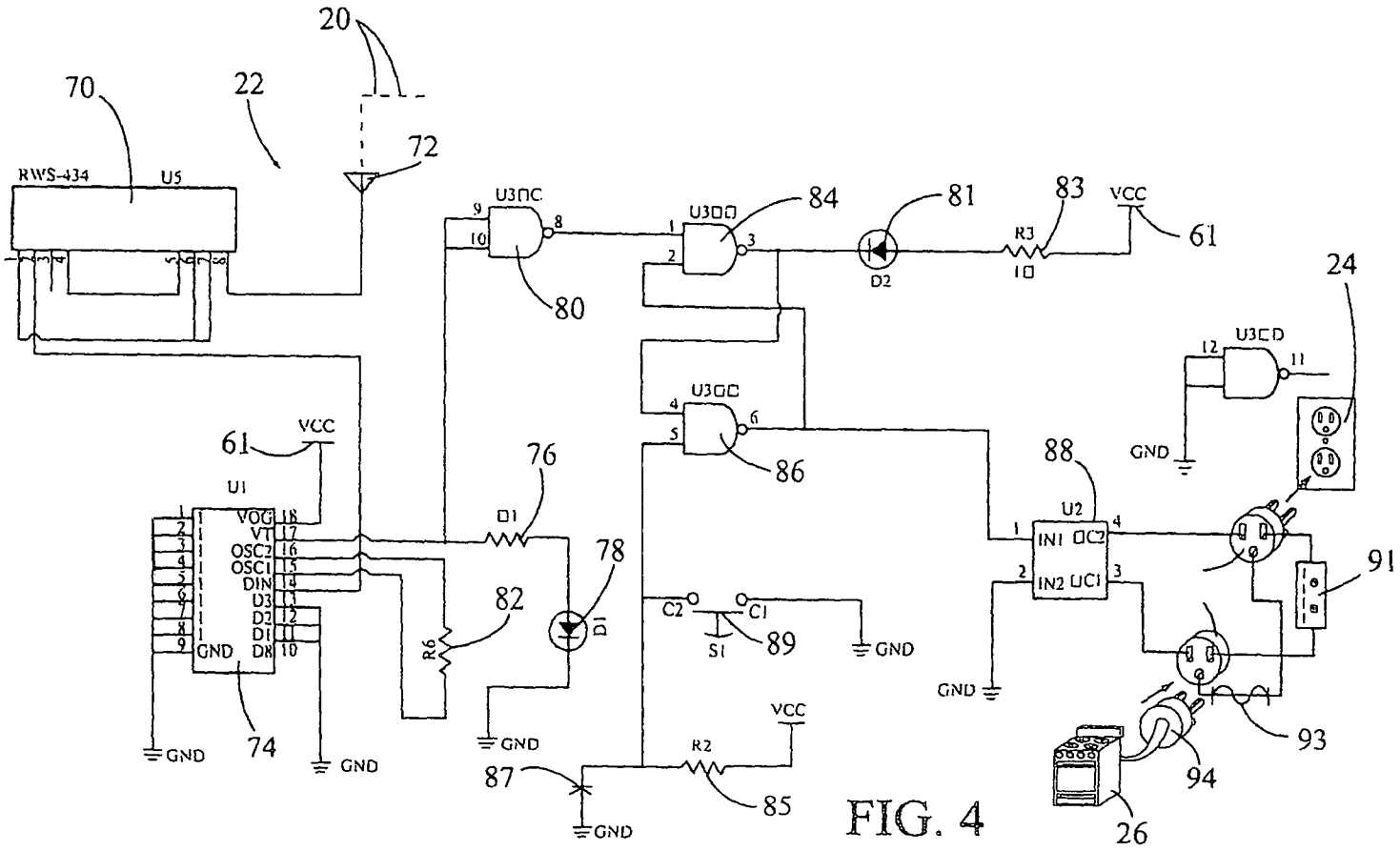

In FIG. 4, a circuit diagram of the receiver and decoder circuit 22 is shown. The circuit 22 includes a radio frequency receiver 70 with an antenna 72 for receiving the radio frequency signal 20 from the transmitter 66. The receiver 70 typically operates in a range of 400 to 500 MHz for detecting the AM radio signal modulation. The receiver 70 is connected to a decoder 74 for producing logic 1 when the radio frequency signal is received. The electrical lead from pin 17 of the decoder 74 is connected to resistor 76, an LED 78 and a logic NAND gate 80. The decoder 74 is also connected to resistor 82.

When the signal 20 is present, the pin 17 goes high and the LED 78 is activated to shown a visual presence of an alarm on the circuit 22. The output of pin 17 goes to the logic NAND gate 80, which converts the signal causing an output pin 8 of the gate 80 to go low. When this happens, a combination of additional logic gates 84 and 86, connected to gate 80, change state and latch. The gate 84 is connected to an LED 81 and a resistor 83. The gate 86 is shown connected to a resistor 85, a capacitor 87, and a reset power switch 89. At this time, the signal to a digital switch 88 turns the electrical power "off" from a first electrical plug 90 connected to the power source 24. The first electrical plug 90 is connected to an appliance AC outlet plug 94 attached to the kitchen stove 26, for example. The two plugs 90 and 92 are wired to a surge protector 91 to prevent any power spikes during the operation of the system 10. Also, the plugs are connected to a rectifier diode 93 for providing a smooth transition of DC power to the AC outlet plug 94.

The power to the kitchen stove 26 or any other electrical or gas operated appliance connected to the plug 92 remains "off" until the reset switch 89 is pressed "on" or the power is removed completely from the circuit 22 and reapplied. When the power is reapplied, the capacitor 87 is discharged and holds a pin 5 on the NAND gate 86 low, thereby resetting the latch combination of the NAND gates 84 and 86. This serves to initialize the circuit 22 when the power is reapplied and returning power for the operation of the kitchen stove 26.

Figure 5:
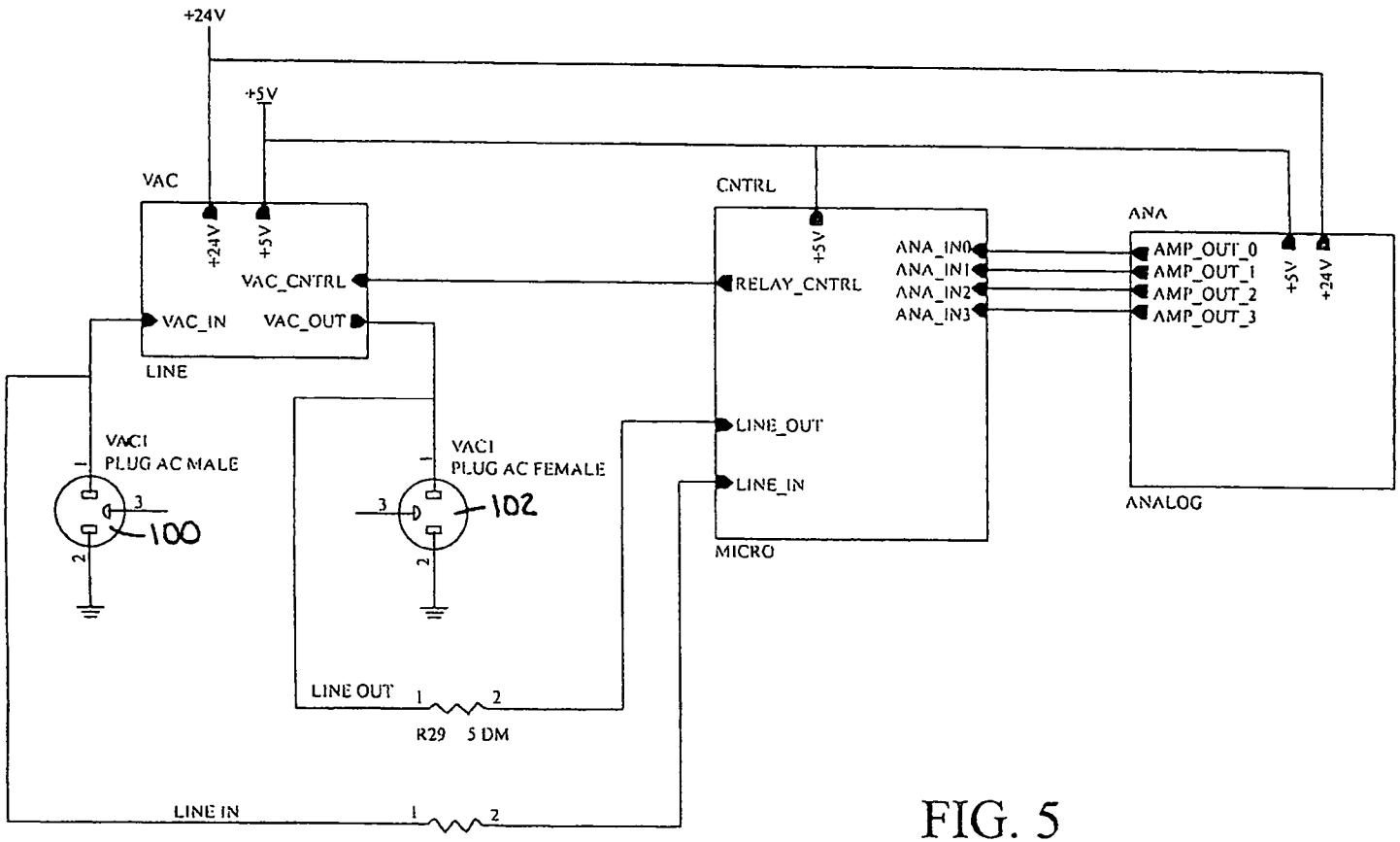
Figure 6:
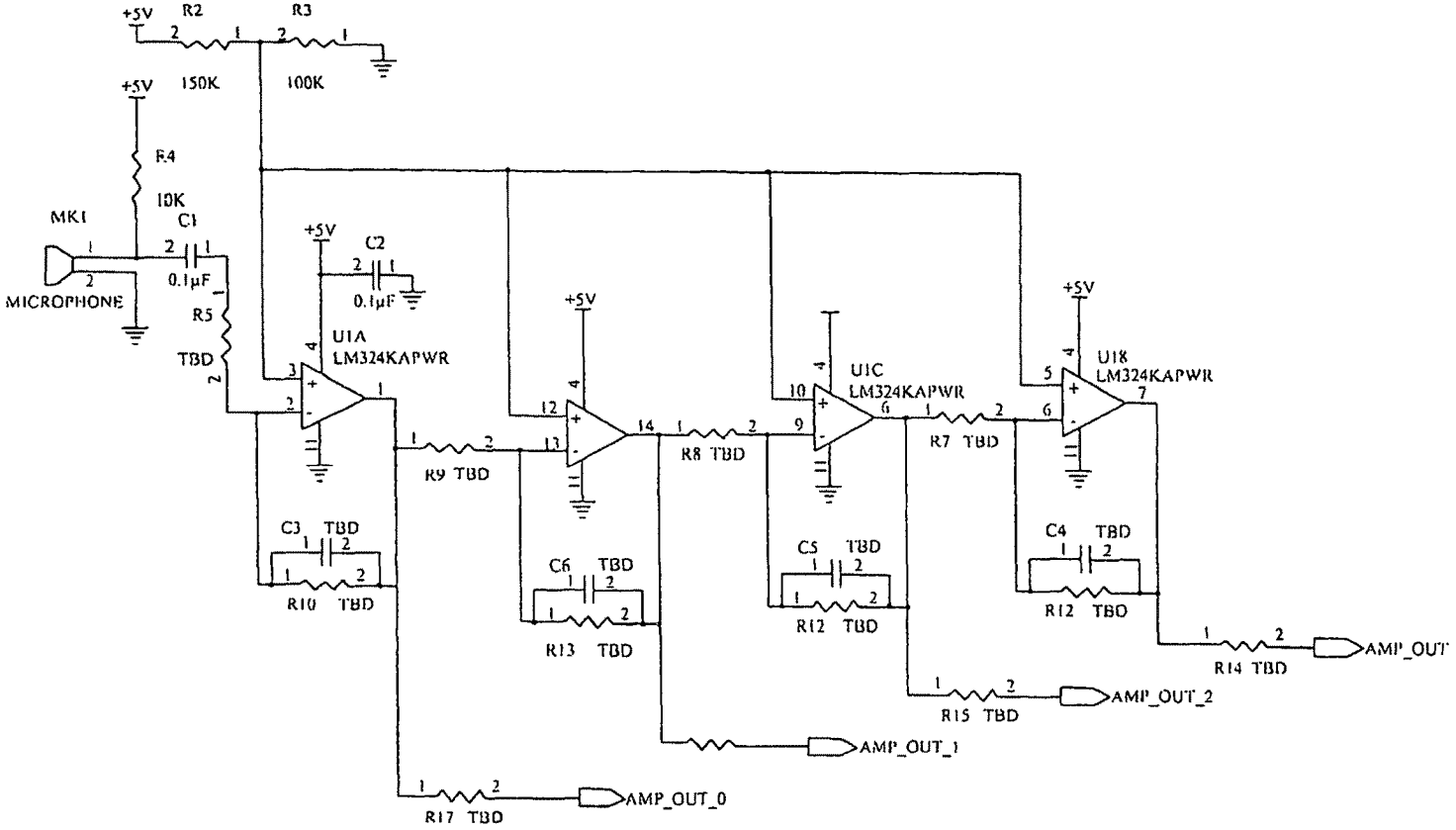

In FIGS. 5-8, another manner of carrying out electrical switching is disclosed and used in conjunction with the switching operation described in FIGS. 1-4. In FIG. 5, the output of the subject electronic system 10 includes a switch input 100 and an output. In this example, the input 100 and the output 102 are shown as male and female connectors. However, the connectors can also be used as circuit breakers. Thus, the signal received can be processed and controlled in an entire circuit in a building. Also, it is contemplated that the circuit system can be programmed to discern between a smoke alarm and a loud noise. The loud noise not intended to disconnect or interrupt the flow of current through the system 10. Further, the electronic system 10 can include a programmable microprocessor 104, shown in FIG. 8, programmed to evaluate and recognize not only the specific sound of a fire or other alarm being monitored and evaluate the duration of the alarm, but also further comprise a time delay or other auxiliary circuit to avoid premature disconnection. This function helps prevent the system from shutting off other circuits and appliances in the event of a false alarm. Also another feature in the subject disclosure is the incorporation of an internet protocol receiver/transmitter or other functional equivalent for communicating with a network, preferably located in the microprocessor. This feature allows the user of the system 10 to operate and control the circuitry discussed above via the internet and respond to an activation of an alarm.

The use of the disclosed switching circuit as breaker switches in a building would allow programming of different circuits in various locations in a building. For instance, in a house or building when medical assistance systems are used, the systems can be programmed to shut off only under very specific conditions, such as where the continued operation of the medical assistance systems may place the occupants in greater danger.

Therefore, the microprocessor 104 would not turn off the circuit unless other nearby circuits have been tripped. Also, the microprocessor 104 of an individual circuit can be used to turn on other circuits depending on the conditions detected or associated with other circuits. For instance, if several fire alarms are detected, then outside emergency lighting of a home or building can be turned on, or garage doors can be automatically opened to allow individuals inside the home to escape.

According to varying embodiments described herein, the system may further comprise one or a plurality of Alarm Fault Circuit Interrupter(s). The Alarm Fault Circuit Interrupter (AFCI) performs in conjunction with audible alarms and or hard-wire detection and/or notification of an alarm condition, generally through the same practice as the GFCI (Ground Fault Circuit Interrupter) performs for potential electrical shocks. The AFCI may communicate via RF or wireless communication via a network as described herein. In practice, the AFCI disrupts electrical power and/or gas distribution to any appliance connected with or to the SST, and terminates power and/or gas to the source that is associated with the alarm condition (i.e., creating the smoke, fire, carbon monoxide and or gas threat). With variations on this embodiment, the SST may further comprise a "Rectifier" and "Surge Protection" circuit to reduce electrical power usage and surges to the appliance containing or connected to the SST.

In one particular embodiment, a wall socket or similar receptacle includes the AFCI, either in addition to or in lieu of the GFCI. These types of receptacles are generally acceptable under existing and established building codes and otherwise comply with local, state, and national regulations. The AFCI/GFCI circuit, employing the various embodiments of the disclosure described herein, may be used for both residential and commercial appliances as well as other electrical and/or gas loads.

The AFCI and related circuitry is able to communicate with the network and systems described herein, and thereby permit a single person to effectively monitor and control an entire home, containing one or multiple zones, so as to manage and control for alarm incidents (i.e., kitchen, furnace room, laundry room, garage, living area, etc.) The AFCI and related circuitry preferably is configured to integrate with the home or businesses primary or secondary electrical panel, although in certain embodiments may be configured to connect with the home or business via RF or other communication protocols. This AFCI and related circuitry will also comprise means for communicating with fire departments, alarm monitoring companies and be controlled visa-via a home owner or designated third party. In certain embodiments, the AFCI will be configured to work in multiple dwelling structures as well as single family homes.

In yet another embodiment, the system further comprises a Smart Fire Department Switch (SFDS). The SFDS and related applications permit fire department or other emergency response personnel to shut off power or other utility to a home, building or other structure prior to entering. The SFDS may be configured with readily recognizable indicia, and function similar to a garage door opener, or in other embodiments may be purely software-driven and function through use of a mobile device connected to a network. In either embodiment, the SFDS preferably comprises the capability of shutting off an electrical panel or gas meter, for example, which in some instances may be incased in concrete or difficult to immediately locate in an emergency event. The Smart Fire Department Switch (SFDS) allows an emergency responder, upon arriving on the scene of a fire or hazard, to promptly turn-off the electricity or other utility to the home/building. This in turn will increase the time and ability of an emergency responder to save lives and mitigate property damage.

With the present and advancing sophisticated technology for detecting air quality and environmental contaminants, individuals and companies have been acquiring systems to warn and also safeguard people, plants and animals. People, plants and animals release dangerous contaminants, impurities and toxins within a confined area or extensive region. Many areas of the planet are being sprayed with chemicals to disable pests and insects; there are reported radiation releases from nuclear power plants; and general manmade and natural environmental pollutants and contaminants. Besides causing illness, ailments or disorder to people, animals and plants, disability and even death has been reported.

Therefore, in one embodiment an Environmental Detection-Protection Switch (EDPS) is provided, which is equipped with one or more sensors for detecting an undesirable environmental hazard and has the capability to provide safeguards from harmful environmental dangers. One example would be if a natural gas leak is detected in or around an occupied structure, the EDPS is alerted and takes the appropriate designated actions. If a warning light or audible alarm is sounded, the occupants will take the appropriate action. Once this or ancillary notification methods have been received by the EDPS, it shall turn off the offending gas, notify the proper authorities and or individuals. The EDPS may also, but not limited to, open or close designated doors and or windows for ventilation and egress, and or engage or disengage electrical or self contained energy appliances, equipment, apparatuses, etc.

Once the designated people and agencies have been notified through IP and or land-lines, additional responses and action may be initiated. If the structure has cameras or viewing portals, the area may be scanned and viewed for possible disabled individuals or animals. Additional action may also be taken remotely by operating electrical circuits or self energy contained appliances, equipment, apparatuses, etc.

In yet further embodiments of the present disclosure, the system comprises a Smart Home Land Security Switch (SHLSS). The SHLSS permits law enforcement, gas companies and or electric companies to turn-off and or turn-on a particular electrical grid and or "gas" lines from a remote location by accessing the network, including via a mobile device. This is especially important to first responders arriving at a major fire or gas-line emergency.

Another aspect of the present disclosure includes the use of a Smart Car Carbon Monoxide Detector (SCCMD). The SCCMD may be comprised of a hand-held unit that is configured to detect dangerous conditions, for example relatively high levels of carbon monoxide within a vehicle or other transportation means. Once the SCCMD notifies the operator of a potential emergency, an informed decision shall be concluded to evacuate the vehicle in a safe area and manner, which may occur by human interaction with the system or may occur automatically, for example instructing the vehicle control system to roll down the windows or shut off the engine. If the area surrounding the vehicle is the hazard, then appropriate and safe measures shall be taken to move the vehicle to a predetermined "safe" zone.

In yet further embodiments, a device is provided for turning "on" a utility or valve, such as a valve connected to the residential or commercial building's water supply. In other embodiments, the device may include the ability to regulate a valve between on and off, and control the utility depending on the status of the condition triggering the alarm. For instance, if an event is detected where there is potential for water damage, the device may automatically shut off the water to the building. In other instances, the device may turn on the water supply to a building's fire suppression system. Variations of this embodiment, including for utilities other than water, are contemplated as within the scope of the invention. For instance, in some buildings it may be desirable to program the device to turn on the furnace or other heating element so as to avoid water pipes freezing and/or bursting. Additionally, the device may incorporate a time delay circuit for turning off the furnace or other heating element once a certain time has elapsed, or alternatively once a certain set point temperature has been reached.

While the exemplary aspects, embodiments, and/or configurations illustrated herein show the various components of the system collocated, certain components of the system can be located remotely, at distant portions of a distributed network, such as a LAN and/or the Internet, or within a dedicated system. Thus, it should be appreciated, that the components of the system can be combined in to one or more devices, such as a tablet-like device, or collocated on a particular node of a distributed network, such as an analog and/or digital telecommunications network, a packet-switch network, or a circuit-switched network. It will be appreciated from the preceding description, and for reasons of computational efficiency, that the components of the system can be arranged at any location within a distributed network of components without affecting the operation of the system. For example, the various components can be located in a switch such as a PBX and media server, gateway, in one or more communications devices, at one or more users' premises, or some combination thereof. Similarly, one or more functional portions of the system could be distributed between a telecommunications device(s) and an associated computing device.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire and fiber optics, and may take the form of acoustic or light waves, such as those generated during radio-wave and infra-red data communications.

In addition, while for purposes of illustration the various embodiments have been frequently described in connection with an audible alarm, it is expressly understood that different types of alarms are contemplated for use with the systems and methods of the present disclosure. For example, photoelectric sensors, photo-switch sensors, infrared sensors, proximity sensors (both capacitive and resistive types), air quality sensors and other sensors may be incorporated with the various devices described herein without departing from the scope of the appended claims. Furthermore, the devices described herein work equally well with medium and high voltage applications. Also, while processes and methods may have been discussed and illustrated in relation to a particular sequence of events, it should be appreciated that changes, additions, and omissions to this sequence can occur without materially affecting the operation of the disclosed embodiments, configuration, and aspects.

As has been shown from the foregoing Detailed Description, various methods are employed when using the systems of the various embodiments. For instance, when an alarm is detected by the system (i.e., smoke, carbon monoxide, or other alarm), all devices, appliances, homes (including single family and multi dwelling units and structures), homeowners and emergency response personnel are alerted automatically. In addition, the information relating to the alarm conditions, or the changing of either logic or power (as described herein) may be made available on one or multiple shared sites, thereby making the information accessible to the Internet of all Things, as well as through any affiliated cloud applications.

Certain methods and systems described herein may further comprise a messaging framework for distributing and sharing information obtained during operation of the systems. In one embodiment, the messaging framework (MF) comprises a collection of computer logic routines used to implement the various configurations of the system, and thereby facilitate the transfer of messages and or data between one or more mobile device(s) connected to the system. In one embodiment, the MF is implemented as a web service, a software system designed to support interoperable machine to machine interaction over a network, providing the interface by which an external process communicates with the system.

According to another embodiment, an external system, either a third party system or a service component, may send a computer message to the MF containing the message or data to be communicated, and may further comprise a unique MF message type identifier. In this particular embodiment, a database may be provided for including defined lists of MF message type identifiers, each of which describes the processing aspects and/or parameters of a specific MF message type. Each message or unique data set, in the form of a computer message and processed by the MF, will contain a message type identifier which uniquely identifies the message type being sent by the external or third party system to one or more of the mobile device(s) connected to the system. Furthermore, encoding of the type described above may also be incorporated to ensure secure access and limited distribution to the messaging and/or data provided by the MF.

A monitoring service may also be provided in various embodiments. The monitoring service is preferably a service tool, which may be used by the system to ensure that the system is continually operational. Periodically, a test message is sent to the application and a response is required if the system is operational. If no response message is returned or an error condition is detected, then the systems will notify a system administrator or other personnel that action must be taken.

According to one embodiment, the systems and methods of this disclosure can be implemented in conjunction with a special purpose computer, a programmed microprocessor or micro-controller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the disclosed embodiments, configurations and aspects includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In yet another embodiment, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or VLSI design. Whether software or hardware is used to implement the systems in accordance with this disclosure is dependent on the speed and/or efficiency requirements of the system, the particular function, and the particular software or hardware systems or microprocessor or microcomputer systems being utilized.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

As described above, various devices may be used in conjunction with systems and methods for facilitating emergency situations, emergency response effectiveness, or to provide support to emergency responders in emergency event, crisis or decision-making situations. U.S. Pat. Nos. 8,423,492 and 8,140,363 are incorporated by reference herein in their entireties for the purpose of supplementing the present disclosure in this regard.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

The present inventions, in various embodiments, include components, methods, processes, systems and/or apparatuses substantially as depicted and described herein, including various embodiments, sub-combinations, and subsets thereof. Those of skill in the art will understand how to make and use the present inventions after understanding the present disclosure. The present inventions, in various embodiments, include providing devices and processes in the absence of items not depicted and/or described herein or in various embodiments hereof, including in the absence of such items as may have been used in previous devices or processes, e.g., for improving performance, achieving ease and\or reducing cost of implementation.

Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An electronic system comprising:

a comparator circuit providing a detection signal when the comparator circuit discerns an ongoing audio alarm indicative of a detected dangerous condition caused by an appliance, the comparator circuit comprising:

a microphone, an amplifier connected to the microphone, a rectifier diode coupled to the amplifier to provide a direct current (DC) voltage that is dependent on an amplitude of the discerned ongoing audio alarm, a second amplifier, comprising a first pin and a second pin, wherein an output from the second amplifier changes from a high voltage to a low voltage to indicate a logic value when a voltage on the first pin exceeds a bias voltage on the second pin, and a first resistor and a second resistor, the first resistor and the second resistor together setting a bias operating point of the amplifier and setting a bias operating point of the second amplifier;

an encoder circuit for encoding the detection signal to provide an encoded detection signal; and a decoder circuit for decoding the encoded detection signal, the decoder circuit comprising a power disconnecting circuit that disconnects electrical power to the appliance in response to the ongoing audio alarm.

2. The electronic system of claim 1, wherein the power disconnecting circuit includes a first electrical plug adapted for receipt in a power outlet and a second electrical plug adapted for receipt in an appliance outlet plug, the first and second electrical plugs connected to a reset power switch; and a surge protector connected to the first electrical plug, the surge protector protecting the system from power spikes.

3. The electronic system of claim 1, wherein the comparator circuit providing a detection signal when the comparator circuit discerns an ongoing audio alarm comprises the comparator circuit providing a detection signal when the comparator circuit discerns between the ongoing alarm and a loud noise.

4. The electronic system of claim 1, further comprising:
a third resistor connected to the microphone and biasing the microphone; and
a fourth resistor acting together with the third resistor to set a gain of the amplifier.

5. The electronic system of claim 1, wherein the decoder circuit includes a light emitting diode (LED) for visually indicating the ongoing audio alarm.

6. The electronic system of claim 1, wherein the comparator circuit further comprises a resistor and a capacitor providing a filter network that charges upon discernment of an ongoing audio alarm.

7. The electronic system of claim 1, further comprising one or more of: an Alarm Fault Circuit Interrupter (AFCI) or a Ground Fault Circuit Interrupter (GFCI).

8. The electronic system of claim 1, wherein the ongoing audio alarm originates from one or more of: a smoke detector or carbon monoxide detector.

9. The electronic system of claim 1, further comprising a transceiver for communicating with a network.

10. The electronic system of claim 9, wherein the network is one or more of: a local area network (LAN), wide area network (WAN), a wireless LAN, a wireless WAN, or the Internet, and
wherein a communication format is one or more of: transmission control protocol/internet protocol (TCP/IP), 802.11g, 802.11n, or BLUETOOTH.

11. The electronic system of claim 1, wherein information relating to one or more of: the ongoing alarm or disconnection of electrical power to the appliance is accessible to an Internet of Things (IoT).

12. A comparator circuit for converting an audio alarm into a logic value, the comparator circuit comprising:
a microphone;
a first resistor, directly connected to the microphone and biasing the microphone;
a first amplifier, connected to the microphone and amplifying a microphone signal from the microphone;
a second resistor, acting together with the first resistor to set a gain of the first amplifier;
a second amplifier, comprising a first pin and a second pin, wherein an output from the second amplifier changes from a high voltage to a low voltage to indicate the logic value when a voltage on the first pin exceeds a bias voltage on the second pin; and
a third resistor and a fourth resistor, together setting a bias operating point of the first amplifier and the second amplifier.

13. The comparator circuit of claim 12, wherein a second resistor, acting together with the first resistor to set a gain of the first amplifier comprises the second resistor, acting together with the first resistor to set a gain of the first amplifier to a specified value.

14. The comparator circuit of claim 12, wherein the comparator circuit discerns ongoing audio alarms from other sounds.

15. The comparator circuit of claim 14, further comprising a rectifier diode coupled to the first amplifier to provide a direct current (DC) voltage that is dependent on an amplitude of discerned audio alarms.

16. The comparator circuit of claim 14, further comprising a fifth resistor and a capacitor providing a filter network that charges upon discernment of an ongoing audio alarm.

17. The comparator circuit of claim 12, wherein an output from the second amplifier changes from a high voltage to a low voltage to indicate the logic value comprises an output from the second amplifier changes from a high voltage to a low voltage to provide a high logic value indicative of a dangerous condition at an appliance.

18. The comparator circuit of claim 12, wherein the comparator circuit is one or more of: an Alarm Fault Circuit Interrupter (AFCI) circuit or a Ground Fault Circuit Interrupter (GFCI) circuit.

19. The comparator circuit of claim 12, wherein the audio alarm originates from one or more of: a smoke detector or carbon monoxide detector.

20. The comparator circuit of claim 12, wherein the comparator circuit communicates with a transceiver for communicating with a network.

21. The comparator circuit of claim 20, wherein the network is one or more of: a local area network (LAN), wide area network (WAN), a wireless LAN, a wireless WAN, or the Internet, and
wherein a communication format is one or more of: transmission control protocol/internet protocol (TCP/IP), 802.11g, 802.11n, or BLUETOOTH.

22. The comparator circuit of claim 12, wherein information relating to one or more of: the audio alarm or the logic value converted by the comparator circuit is accessible to an Internet of Things (IoT).

23. An electrical device connected to a power source, the power source providing power to an appliance, the electrical device comprising:
a comparator circuit, the comparator circuit providing a detection signal when the comparator circuit discerns an ongoing audio alarm from other sounds, the ongoing audio alarm indicative of a detected dangerous condition caused by the appliance, the comparator circuit comprising:
a microphone;
an amplifier connected to the microphone;
a rectifier diode connected to the amplifier to provide a direct current (DC) voltage that is dependent on an amplitude of the ongoing audio alarm;
a resistor and a capacitor providing a filter network that charges upon discernment of an ongoing audio alarm;
a second amplifier, comprising a first pin and a second pin, wherein an output from the second amplifier changes from a high voltage to a low voltage to indicate a detection signal when a voltage on the first pin exceeds a bias voltage on the second pin; and
a second resistor and a third resistor, the second resistor and the third resistor together setting a bias operating point of the amplifier and setting a bias operating point of the second amplifier; and
a power disconnecting circuit that upon discernment of the ongoing audio alarm disconnects the appliance from the power source to mitigate the detected dangerous condition.

24. The electrical device of claim 23, further comprising
a fourth resistor, directly connected to the microphone and biasing the microphone; and
a fifth resistor, acting together with the fourth resistor to set a gain of the first amplifier.

25. The electrical device of claim 23, wherein the electrical device comprises one or more of: an Alarm Fault Circuit Interrupter (AFCI) or a Ground Fault Circuit Interrupter (GFCI).

26. The electrical device of claim 23, wherein the electrical device comprises one of: an electrical outlet or an electrical receptacle.

27. The electrical device of claim 23, further comprising a surge protector connected to the power source, the surge protector protecting components of the electrical device from power spikes.

28. The electrical device of claim 23, further including a rectifier diode connected to the power source to provide a smooth transition of DC power.

29. The electrical device of claim 23, wherein the ongoing audio alarm originates from one or more of: a smoke detector or carbon monoxide detector.

30. The electrical device of claim 23, further comprising a transceiver for communicating with a network.

31. The electrical device of claim 30, wherein the network is one or more of: a local area network (LAN), wide area network (WAN), a wireless LAN, a wireless WAN, or the Internet, and wherein a communication format is one or more of: transmission control protocol/internet protocol (TCP/IP), 802.11g, 802.11n, or BLUETOOTH.

32. The electrical device of claim 23, wherein information relating to one or more of: the ongoing alarm or disconnection of the appliance from the power source is accessible to an Internet of Things (IoT).

* * * * *